US005996115A

United States Patent [19]

Mazelsky

[11] Patent Number: 5,996,115

[45] Date of Patent: Dec. 7, 1999

[54] FLEXIBLE BODY ARMOR

[75] Inventor: Bernard Mazelsky, West Covina, Calif.

[73] Assignee: ARA, Inc., City of Industry, Calif.

[21] Appl. No.: 07/934,406

[22] Filed: Aug. 24, 1992

[51] Int. Cl.[6] ..... F41H 1/02; F41H 5/08

[52] U.S. Cl. ..... 2/2.5; 428/911; 89/36.02; 89/36.05

[58] Field of Search ..... 2/2, 2.5, 51, 44, 2/102, 108; 428/911, 52, 44, 48, 49; 89/36.02, 36.05, 36.08

[56] References Cited

U.S. PATENT DOCUMENTS

| | | | |
|---|---|---|---|
| 1,758,296 | 5/1930 | Schaumann | 428/911 |
| 3,867,239 | 2/1975 | Alesi et al. | 2/2.5 |
| 3,871,026 | 3/1975 | Dorre | 89/36.05 |
| 3,924,038 | 12/1975 | McArdle et al. | 2/2.5 |
| 4,198,707 | 4/1980 | Haupt et al. | 428/911 |
| 4,241,457 | 12/1980 | Klein et al. | 2/2.5 |
| 4,391,178 | 7/1983 | Pagano | 89/36.08 |
| 4,473,653 | 9/1984 | Rudoi | 2/2.5 X |
| 4,483,020 | 11/1984 | Dunn | 2/2.5 |
| 4,529,640 | 7/1985 | Brown et al. | 428/911 |
| 4,633,756 | 1/1987 | Rudoi | 2/2.5 |
| 4,660,223 | 4/1987 | Fritch | 2/2.5 |
| 4,760,611 | 8/1988 | Huet et al. | 2/2.5 |
| 4,923,728 | 5/1990 | Snedeker | 2/2.5 |
| 5,221,807 | 6/1993 | Vives | 89/36.02 |
| 5,686,689 | 11/1997 | Snedeker et al. | 89/36.02 |

*Primary Examiner*—Charles T. Jordan
*Assistant Examiner*—Jeffrey Howell
*Attorney, Agent, or Firm*—Bonilard I. Brown

[57] ABSTRACT

An articulated body armor garment has a single layer of ceramic tiles adhesively attached to a flexible fragment-trapping blanket. A foam spacer layer behind the blanket at least partially contains deformation of the blanket in a ballistic attack. The blanket preferably includes at least forty plies of a ballistic cloth stitched together in a quilt pattern. Edge areas of the ceramic tiles are beveled so that edges of adjacent tiles overlap, thus enabling the array of tiles to present an essentially continuous unbroken surface to a projectile.

26 Claims, 2 Drawing Sheets

FLEXIBLE BODY ARMOR

BACKGROUND OF THE INVENTION

1. Field of the Invention

The present invention relates to personal body armor, e.g., a vest adapted to be worn by military personnel or peace officers to protect against death or serious injury from ballistic threats.

2. Prior Developments

A variety of improvements have been made in flexible armor materials and combinations of materials in efforts to meet ballistic threats. U.S. Pat. No. 3,841,954 to Lawler discloses a laminated panel or plate formed of multiple layers of fabric stitched together and compressed under heat and pressure, whereby the panel is made rigid for use as a component in body armor. U.S. Pat. No. 3,509,833 to Cook discloses a flexible armor of ceramic tiles mounted on a backing of flexible fibers arranged in a cross-ply laminated pattern.

U.S. Pat. No. 4,522,871 to Armellino, et al., and U.S. Pat. No. 4,780,351 to Czempoyesh, suggest flexible armor comprising multiple layers of a woven polyaramid fiber, e.g., the material marketed under the trademark KEVLAR.

U.S. Pat. No. 4,608,717 to Dunbavand suggests a flexible armor comprising multiple layers of polyaramid fibers in combination with an intermediate layer of packed feathers, foam or felt material. The layers are stitched together to form an integral flexible panel.

U.S. Pat. No. 3,924,038 to McArdle, et al., discloses a multi-layer panel apparently useful in a pilot's flak suit or as a temporary covering for stored aircraft or equipment in a battle zone. The panel is designed to protect against flying fragments generated by exploding munitions. The multi-layer panel comprises an inner cushion zone of nylon cloth and felt, an intermediate honeycomb spacer, and an outer protective layer of ceramic tiles. The honeycomb spacer apparently serves to rigidize the panel into a non-flexible structure.

U.S. Pat. No. 5,060,314 to Lewis shows a body armor jacket formed of flexible ballistic cloth having internal pockets for receiving hard armor inserts. Add-on shoulder pads have flotation pads, apparently intended to provide buoyancy in water.

U.S. Pat. Nos. 3,867,239 to Alesi, et al., No. 4,198,707 to Haupt, et al., and No. 4,633,756 to Rudoi, show armor panels comprising multi-hardened plates arranged in multiple layers on a fabric backing.

SUMMARY OF THE INVENTION

The present invention contemplates flexible body armor comprising multiple ceramic tiles adhesively attached to a multi-layer fragment barrier blanket formed of ballistic cloth plies stitched in a quilt pattern. The ceramic tiles are firmly adhesively attached to the blanket so that fragments generated by projectile impact against the tile surface are adhesively retained against passage through the blanket layers.

In a preferred embodiment of the invention, the ceramic tiles have beveled side edges, whereby beveled edge surfaces on adjacent tiles interfit together to avoid gaps or voids between adjacent tiles. A projectile striking the array of tiles at the edge joint between two adjacent tiles encounters edge areas of both tiles, and thus projectile penetration resistance along the tile edges is approximately the same as the resistance at any point on the tile face. The individual tiles can tilt relative to adjacent tiles so that the body armor can flex or bend to accommodate the contour of the person wearing the armor.

A relatively soft foam layer is provided on the rear (inner) surface of the fragment barrier blanket. The foam layer spaces the fragment barrier blanket away from the body of a wearer so that any deformation of the blanket by projectile impact on the ceramic tiles is absorbed by the foam layer rather than by the person's body.

A flexible body armor element embodying features of the invention is capable of defeating a Type IIIA ballistic threat, as defined by the National Institute of Justice Standard 0101.03. A Type IIIA threat is the threat imposed by a 44 Magnum projectile having a mass of 15.5 grams impacting at a velocity of 1400 feet per second, or a 9 millimeter full metal jacket bullet having a mass of 8 grams impacting at a velocity of 1400 feet per second. Defeating the threat requires that the target be deformed in the direction of attack by a distance less than 44 millimeters (1.73 inches).

DESCRIPTION OF A PREFERRED EMBODIMENT OF THE INVENTION

Figure 1:
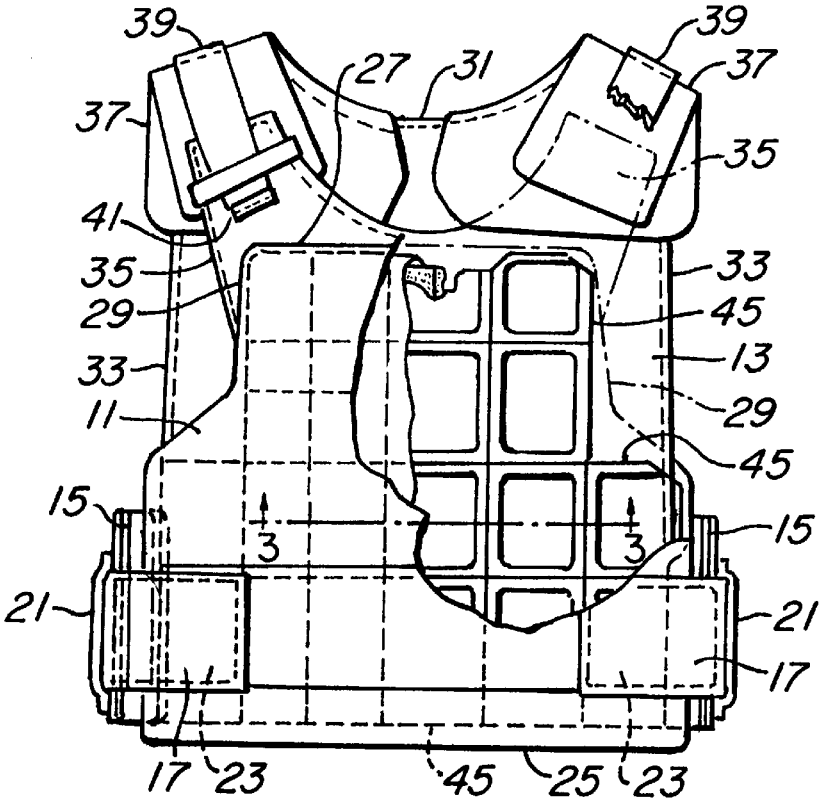
FIG. 1 is a front elevational view of an articulated armor vest embodying features of the present invention.
Figure 2:
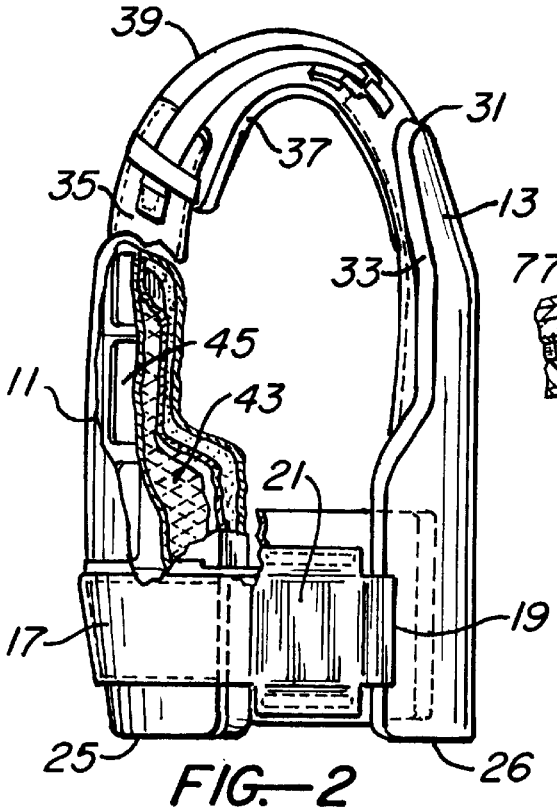
FIG. 2 is a side elevational view of the vest of FIG. 1.

Referring to the drawings, FIGS. 1 and 2 show an articulated armor vest comprising a front panel 11, a rear panel 13, and two side panels 15. Straps 17 are anchored to the rear panel, as at 19, for extension through loops 21 on side panels 15. The forward ends of straps 17 have adhesive patches on their rear faces for engagement with adhesive patches 23 located on panel 11, whereby the straps serve to mount side panels 15 and to interconnect the front and rear panels near their lower edges 25, 26. Each adhesive patch may be formed of an adhesive fibrous hook and loop material, e.g., the materials marketed under the trademark VELCRO.

Front panel 11 has an upper edge 27, two side edges 29, and a lower edge 25. The panel has sufficient area to protect the wearer's vital organs from frontal attack by a ballistic projectile. Rear panel 13 has an upper edge 31, two side edges 33, and a lower edge 26. The rear panel is somewhat larger in area than the front panel, sufficient to protect the wearer's vital organs from ballistic attack from the zone behind the person wearing the vest. The front and rear panels have internal ceramic tiles covering essentially the entire panel area for intercepting high velocity rifle projectiles directed at the wearer, e.g., a 30 caliber armor piercing projectile. Each side panel 15 has a single flexible ballistic insert therein to protect against side attack against the wearer's rib areas.

The upper portion of front panel 11 is designed to overlie the wearer's chest area just below shoulder level. A flexible scalloped panel 35 is sewn or otherwise attached to the upper portion of front panel 11 to extend up to the wearer's shoulders. Two shoulder pads 37 extend from rear panel 13 over the wearer's shoulders and overlap the scalloped panel 35. Flexible straps 39 extend from the shoulder pads 37 for releasable attachment to panel 35, as by means of VELCRO fasteners, as indicated in FIG. 1. A VELCRO patch 41 is attached to each panel 35 to cooperate with patches of mating VELCRO fasteners secured on the under side of each of straps 39. The VELCRO adhesive patches comprise fibrous hook and loop material, as earlier indicated. The effective length of each strap 39 is adjustable by means of the buckle arrangement indicated, to meet individual size requirements, with the end portions of straps 39 being retained by loops secured to panels 35, as shown.

The present invention involves the internal construction of front panel 11 and/or rear panel 13, whereby a wearer is effectively protected from projectile attack. Each panel 11 or 13 may have similar internal construction, although the number of ceramic tiles employed in the rear panel will be greater because of its greater face area.

Figure 3:
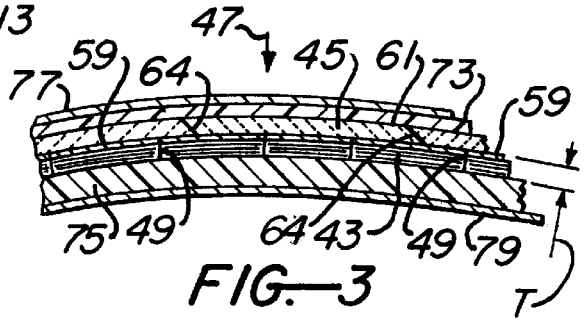
FIG. 3 is a fragmentary sectional view taken through the front panel of the vest of FIG. 1.

FIG. 3 shows in some detail a representative panel construction. The flexible panel includes a fragment trapping blanket 43 formed of multiple layers of ballistic cloth stitched together in a quilt pattern, whereby the blanket captures and retains fragments and particulates generated by projectile impact against ceramic tiles 45 that are adhesively attached to the outer surface of the blanket. A projectile path against the armor panel is indicated by numeral 47 in FIG. 3.

Blanket 43 is preferably comprised of several plies 44 of ballistic cloth sewn together by stitching 49. The stitch pattern may include a first group of stitches arranged in a square pattern spaced about two and one-half inches apart, and a second group of stitches arranged in a diagonal (or diamond) pattern at a forty-five degree angle to the first group of stitches. The number of plies of ballistic cloth in blanket 43 may be varied, depending upon the level of ballistic protection desired or required. Experimental work has been conducted primarily with blankets containing forty-four plies of ballistic cloth. Forty-four of the plies were formed of the sheet material depicted in FIGS. 4 and 5.

Figure 4:
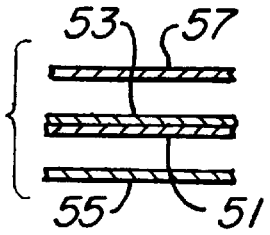
FIG. 4 is a fragmentary sectional view of a ballistic cloth material utilized in the FIG. 3 panel, the material being shown with the plies or layers of the cloth material separated prior to being laminated together.
Figure 5:
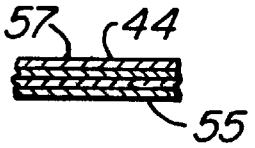
FIG. 5 is a view similar to that of FIG. 4, but showing the plies laminated together.

A preferred ballistic cloth material for the blanket 43 plies is a laminated fibrous sheet material marketed by Allied Signal Corp. under the trademark SPECTRA SHIELD. FIGS. 4 and 5 show the laminated sheet material in two stages of formation, i.e., prior to the lamination process, and after the lamination process. The ballistic cloth comprises two inner resin-impregnated fiber sheets 51 and 53, wherein high tensile strength fibers extend parallel to each other with minimal spacing therebetween. The fiber sheets are arranged with the fibers in the respective sheets extending crosswise of each other, i.e., at ninety degrees. Two polyethylene sheets or films 55, 57 are laminated onto the exposed faces of fibrous sheets 51, 53 to complete the composite ballistic cloth or sheet 44. The total thickness of the laminated composite sheet 44 is about 0.007 inch. The composite sheet has a weight of about 4.5 ounce per square yard face area dimension. As noted above, blanket 43 may be comprised of forty-four plies of the high strength ballistic sheet material depicted in FIG. 5.

The projectile-trapping blanket 43 has its outer surface defined by a single ply of a woven fabric material 59 having an adhesive affinity for a ceramic adhesive, typically polysulfide adhesive. A suitable woven material is available from the DuPont Company under the tradename NOMEX. Other woven fabric materials having an adhesion affinity with polysulfide adhesive, etc., may be utilized.

The purpose of woven ply 59 is to provide blanket 43 with an outer surface that will adhesively bond to ceramic tiles 45. The earlier mentioned material marketed under the name SPECTRA SHIELD cannot be effectively or strongly bonded to the ceramic tiles. It is necessary to provide a woven fabric facing material, such as the above-mentioned material marketed under the trademark NOMEX, to achieve a satisfactory bond between the ceramic tiles and blanket 43. The woven fabric facing material 59 is stitched to the other plies 44 to form the unitary one-piece flexible blanket 43. Typically, blanket 43 will have a thickness dimension T of about 0.3 inch.

Figure 6:
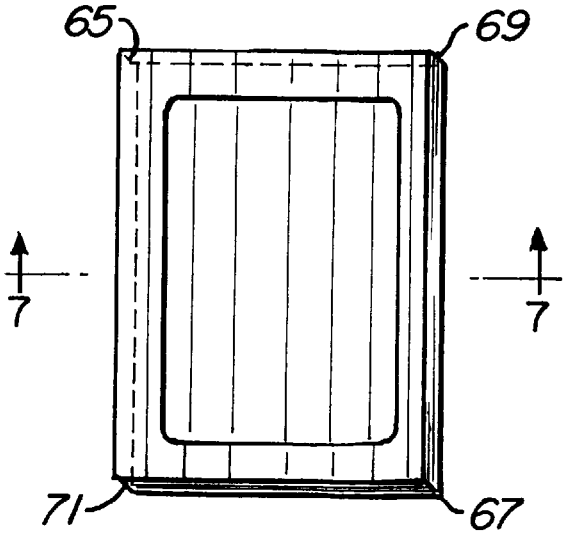
FIG. 6 is a plan view of a ceramic tile utilized in the panel of FIGS. 1 and 3.
Figure 7:
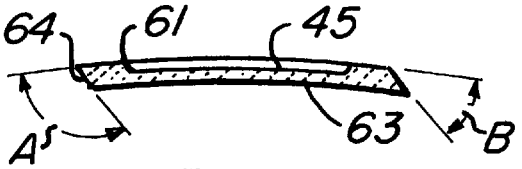
FIG. 7 is a transverse sectional view taken on line 7—7 in FIG. 6.

FIGS. 6 and 7 illustrate one of the ceramic tiles that are bonded to the outer surface of multi-layer blanket 43. Various different metallurgical combinations of materials may be utilized in the ballistic tile fabrication. The work herein referenced was carried out with tiles formed of silicon carbide. Silicon carbide can be mixed with boron carbide to provide improved ballistic efficiency by increasing the tile hardness, as well as reducing the tile weight.

The individual tile 43 has an outer surface 61 that is slightly curved and convex, and an inner surface 63 that is slightly curved and concave. As shown in FIGS. 6 and 7, the central portion of the convex outer surface is slightly recessed relative to border areas of the tile. The recessed surface is for weight reduction purposes, and has no ballistic purpose or advantage. The slight curvature of tile surfaces 61, 63 is to facilitate a slight or partial encirclement of the tile assembly about the wearer's body, i.e., the array of tiles forms an arcuate shield about the front and rear portions of the wearer's body, as may be seen in FIG. 3.

The slight curvature of tile surface 61 also has an advantageous ballistic action, in that stresses generated in the tile by an impacting projectile tend to be propagated laterally from the point of impact into the tile material, rather than punching axially through the tile material. The tiles are enabled to more completely absorb the projectile energy.

As seen in FIGS. 3 and 6, adjacent tiles have beveled side edges 64 in abutment with each other, whereby an overlying edge area of one tile overlaps an underlying edge area of an adjacent tile. This is to eliminate any gaps or voids between the tiles, as might form breaks or weak zones in the ballistic shield provided by the tiles. The overlap provided by the beveled edge construction also ensures that the ballistic effectiveness of each tile edge area is approximately the same as the ballistic effectiveness of the central tile areas spaced away from the tile edges. When a projectile impacts a tile at its edge area, the projectile must penetrate edge areas of two tiles in order to reach the associated fragment-trapping blanket 43.

To achieve the desired tile edge overlap, all four edges of each rectangular tile should be beveled. Two of the beveled edges of each tile are angled at an obtuse angle A (FIG. 7) to the outer surface 61 of the tile. Two of the beveled edges of each tile are inclined at an acute angle B (FIG. 7) to the outer surface 61 of the tile. The obtuse angle A may preferably be about 135°, whereas the acute angle B is about 45°.

Figure 8:
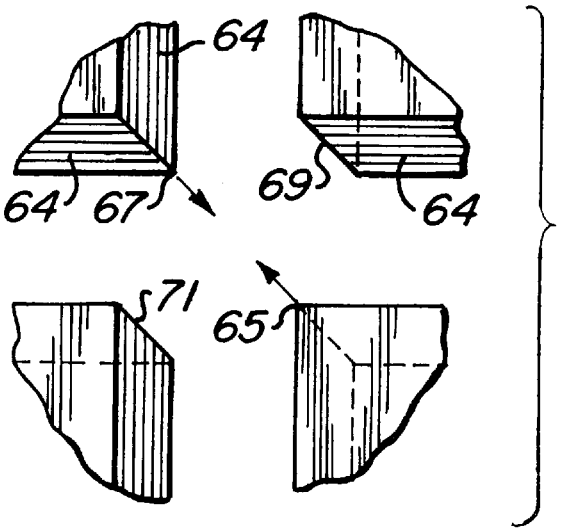
FIG. 8 is a fragmentary sectional view showing four tiles prior to their joining together to form a tile assembly.

As seen in FIG. 8, the beveled edges 64 are indexed or arranged in pairs so that two obtuse-angled edges are engaged or connected together to form a corner 65. The other two beveled edges are connected to each other to form a second corner 67 diagonally opposite corner 65. The other two corners 69 and 71 are chamfered to facilitate placement of the tiles in edge-to-edge abutment.

FIG. 8 fragmentarily illustrates the corner areas of four ceramic tiles prior to movement of the tiles into the edge-to-edge abutment indicated in FIG. 3. Corner areas 65 and 67 may be advanced toward each other, as indicated by the arrows. Sequentially or concurrently, the chamfered edges 69 and 71 are moved together, so that all four tiles have their beveled edges abutting and overlapping, as shown in FIG. 3.

FIG. 1 shows in broken lines various rectangular tiles arranged in edge-abutment relationship within the front panel 11. A similar tile arrangement may be utilized in the rear panel 13, using more tiles. The individual tiles may preferably have a width dimension of about three inches and a length dimension of about four inches. The tile thickness dimension may be about 0.32 inch in the border portion of the tile and about 0.26 inch in the central recessed portion of the tile. Preferably, all tiles are identically constructed and dimensioned.

Because the outer surfaces of ceramic tiles 45 are relatively hard, a softer outer surface may be provided by utilizing a layer of foam plastic 73, about one-fourth inch thick, on the outer surfaces of the tiles. The softer surface provided by the foam is easier on a person's hands when coming into contact with the outer surface of the vest. Also, the foam plastic layer 73 offers some protection against tile breakage should the vest be thrown about or abused. A further purpose for foam plastic layer 73 is to impart a degree of water buoyancy to the panel. Plastic foam layer 73 has essentially no ballistic advantage.

A second relatively soft foam layer 75 is secured to the inner surface of blanket 43. This plastic foam material may preferably be that marketed under the trade name ENSOLITE. The foam layer 75 thickness may preferably be about one quarter to one-half inch. Its purpose is to space blanket 43 from the wearer's body, and thus to accept blanket deformation, when a projectile fragments tiles 45 to deform the blanket, and thereby shield the wearer from such deformation.

The various components 43, 73 and 75 are preferably coextensive with the area of the panel, as viewed in FIG. 1, whereby the panel has essentially the same ballistic performance in every portion thereof.

In a preferred form of the invention, a non-permeable sheath extends about tiles 45, blanket 43, and foam layers 73 and 75. As shown in FIG. 3, an outer sheath wall 77, an inner sheath wall 79, and connector edge walls (not shown) extending about and along sheath walls 77 and 79, provide a complete encapsulation about the operating components of the ballistic panel.

The encapsulating sheath may be formed of a polyurethane film material marketed by the Tuftane Co. under its product designation TF-460. A suitable film thickness is about 0.010 inch. After two sheaths of the polyurethane film have been applied to opposite faces of the panel, mating edge areas of the films may be heat sealed to an encapsulate of the panel components. Air trapped within the encapsulated panel may be relieved to a controlled degree, as by means of a vacuum pump, thus to control the amount of air trapped within the panel. The foam and the remaining air provide a water buoyancy characteristic desirable in many military uses. The polyurethane film also serves to contain the foam layers 73 and 75. Fragments generated by projectile impact against the panel are contained by the cooperative effect of blanket 43, foam layer 75, and sheath wall 79. The panel of FIG. 3 may have an overall thickness of about 1.2 inches.

Certain ballistic tests have been conducted on panel sections constructed generally as shown in FIG. 3. Panel sections measuring about 9 inches by 9 inches were mounted in a 12 inch square cavity having a clay back-up filling. Test projectiles were fired at a ninety degree angle to the panel surface. A 0.30 caliber projectile weighing 150 grains and striking the target at an impact velocity of about 2775 feet per second produced a deformation in the clay surface of about 1.7 inches. Fragment penetration of protective blanket 43 extended between 18 plies minimum penetration, and 34 plies maximum penetration. The final nine plies of the blanket remained intact. The areal density of the configuration tested was 5.8 pounds per square foot. Improvements can be provided for the tile composition, as by combining boron carbide powder with the silicon carbide, thereby lowering the combined areal density to 5.5 pounds per square foot, while maintaining the same hardness as with a heavier silicon carbide tile.

A 9 millimeter projectile weighing 124 grains was fired to impact a test panel at a velocity of 1434 feet per second. Deformation of the clay mounting surface was about 0.30 inch, and the blanket remained largely intact, with damage limited primarily to the ceramic tile. Test results were essentially the same, whether the projectile was fired against the central area of a tile or at an overlapping tile's edge area.

In order to ascertain the effect of the ballistic blanket 43, some comparison test firings were made, using only the blanket as the target, with no tiles or foam layers. A 9 millimeter projectile (as described in the level III A NIJ Specification), impacting the target at a velocity of about 1440 feet per second, produced a deformation in the clay backup surface of about 1.25 inches. The blanket exhibited appreciable damage in the blanket plies and the connector stitching threads. The use of the multi-ply blanket in combination with the ceramic tiles produced a higher level of protection than the use of the blanket alone without the tiles.

Further testing was performed on the FIG. 3 panel construction, using an AK-47 automatic weapon round having a target impact velocity of about 2400 feet per second. This round comprised a steel core to form what has become known as the "Chinese-Communist" threat. Deformation of the clay backup surface measured about 0.9 inch. Additional tests were carried out with a 5.56 millimeter projectile weighing 55 grains. With a target impact velocity of about 3300 feet per second, the clay deformation measured about 0.58 inch. In each case the final ply of the blanket remained intact.

A 30 caliber armor piercing bullet weighing 166 grains and impacting the target at a velocity of 2850 feet per second represents a Type IV threat under National Institute of Justice Standard 0101.03.

A modified form of the FIG. 3 panel construction, containing fifty-three plies in the blanket, defeated the Type IV threat. Varying the number of plies in the blanket produced varying levels of protection. It is believed that in order to meet known threats the blanket should contain at least forty-four plies and no more than about fifty-three plies. Increase of ceramic tile thickness to about 0.35 inch is also required.

The articulated armor vest of FIGS. 1, 2 and 3 weighs approximately eighteen pounds. The front and rear panels 11 and 13 are relatively flexible to fit reasonably well on a person wearing the vest. The curved surface contours of the tiles facilitate such fit.

A feature of interest is that the tiles being adhesively attached to the outer surface of flexible blanket 43 during a ballistic penetration of the tiles assists such adhesion in retaining tile fragments in the blanket. Another feature of interest is that the beveled edge tile construction enables the tiles to present an essentially unbroken outer surface to a projectile, without adversely affecting garment flexibility, and without requiring multiple layers of tile. Only a single layer of tiles is utilized, thereby minimizing overall weight and garment bulk.

Thus there has been shown and described a novel flexible body armor which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. Flexible armor for wearing on the body of a person comprising:

a multiple ply flexible blanket including multiple layers of ballistic cloth stitched together in a quilt pattern to form a fragment barrier, said blanket having an outer surface and an inner surface, an array of ceramic tiles in a layer and adhesively attached to the outer surface of said blanket, said tiles having outer surfaces remote from the blanket and inner surfaces adhesively attached to the blanket, said tiles having beveled edges, some of said tile edges extending at an obtuse angle to the tile outer surfaces, the remaining tile edges extending at an acute angle to the tile outer surfaces, the tile edges being so indexed about the tile peripheries that adjacent tiles have their edges in facial engagement to eliminate gaps between the tiles, the inner surface of each ceramic tile of at least a major portion of said tiles having a curved concave contour to reduce separation of adjacent tiles upon flexing at joints between tiles.

2. Flexible body armor according to claim 1, wherein:

each tile is generally rectangular in configuration, each tile having four corners, two of said corners being chamfered so that the chamfered surfaces on diagonally adjoining tiles mate together to eliminate gaps at the tile corners.

3. Flexible body armor according to claim 1, wherein each tile is generally rectangular in configuration, each tile having four side edges, two of said side edges extending at an obtuse angle to the tile outer surfaces, and the other two side edges extending at an acute angle to the tile outer surfaces.

4. Flexible body armor according to claim 3, wherein said two side edges meet to form one corner of said tile, and said other two side edges meet to form a second corner of said tile.

5. Flexible body armor according to claim 4, wherein each tile has the same edge contour so that the four beveled edges on a given tile mate with beveled edges on up to four adjoining tiles.

6. Flexible body armor according to claim 1, wherein:

the outer surface of said fragment barrier blanket comprises a flexible woven fabric having an adhesive affinity for ceramic adhesives, whereby tile fragments generated by projectile impact forces have firm adhesive attachment to said flexible woven fabric.

7. Flexible body armor according to claim 1, wherein each ceramic tile has a thickness of about 0.3 inch.

8. Flexible body armor according to claim 7, and further including a foam spacer pad having a thickness of about one-fourth to one-half inch.

9. Flexible body armor according to claim 7, and further comprising:

a water-impermeable sheath enveloping said tiles, blanket and foam spacer pad.

10. Flexible body armor according to claim 9, wherein said water-impermeable sheath is formed of a polyurethane film which encases said tiles, blanket and foam spacer pad, whereby gas is entrapped within the sheath to make the body armor water buoyant.

11. Flexible body armor of claim 1, wherein the outer surface of each ceramic tile has a curved convex contour.

12. Flexible body armor according to claim 1, wherein said tiles are formed of silicon carbide.

13. Flexible body armor according to claim 1, wherein said tiles are formed of silicon carbide and boron silicate.

14. Flexible Armor according to claim 1, wherein:

the outer surface of each ceramic tile of at least a major portion of the tiles has a curved convex contour to cooperate in reducing separation of adjacent tiles upon flexing at joints between tiles.

15. Flexible Armor according to claim 1, and further comprising:

raised edge portions extending outwardly from the convex curved surfaces of said tiles to provide thicker tile portions about the peripheries of the tiles for added projectile impact resistance and strength.

16. A multiple ply flexible blanket including multiple layers of ballistic cloth stitched together in a quilt pattern to form a fragment barrier, said blanket having an outer surface and an inner surface, each layer of ballistic cloth comprising two internal resin-impregnated fiber sheets having the fibers therein crossing at an angle of about ninety degrees, and two facing films of thermoplastic material laminated onto oppositely-facing surfaces of the resin-impregnated fiber sheets, and an array of ceramic tiles adhesively attached to the outer surface of said blanket, said tiles having outer surfaces remote from the blanket and inner surfaces adhesively attached to the blanket, said tiles having beveled edges, some of said tile edges extending at an obtuse angle to the tile outer surfaces, the remaining tile edges extending at an acute angle to the tile outer surfaces, the tile edges being so indexed about the tile peripheries that adjacent tiles have their edges in facial engagement to eliminate gaps between the tiles.

17. Flexible body armor according to claim 16, wherein said blanket comprises about forty layers of ballistic cloth.

18. Flexible armor for wearing on the body of a person, comprising:

a multiple ply flexible blanket including multiple layers of ballistic cloth stitched together in a quilt pattern to form a fragment barrier, said blanket having an outer surface and an inner surface, an array of ceramic tiles adhesively attached to the outer surface of said blanket, said tiles having outer surfaces remote from the blanket and inner surfaces adhesively attached to the blanket, said tiles having edges abutted together so that the array of tiles presents an essentially unbroken gap-free surface to an incoming projectile, the inner surface of each ceramic tile of at least a major portion of said tiles having a curved concave contour to reduce separation of adjacent tiles upon flexing at joints between tiles, and a continuous resilient foam spacer pad engaged with the inner surface of said blanket, whereby the blanket is spaced an appreciable distance from the persons body.

19. Body armor according to claim 18, wherein:

the outer surface of said fragment barrier blanket is a flexible woven fabric having an adhesive affinity for ceramic adhesives, whereby tile fragments generated by projectile impact forces have a firm adhesive attachment to said flexible woven fabric.

20. Body armor according to claim 18, wherein each ceramic tile has a thickness of about 0.32 inch.

21. Body armor according to claim 20, wherein said foam spacer pad has a thickness of about one quarter to one-half inch.

22. Body armor according to claim 18, wherein the outer surface of each of at least a major portion of said ceramic tiles has a curved convex contour.

23. Flexible Armor according to claim 14, and further comprising:

raised edge portions extending outwardly from the convex curved surfaces of said tiles to provide thicker tile portions about the peripheries of the tiles for added projectile impact resistance and strength.

24. Flexible armor for wearing on a persons body, comprising:

a multiple ply flexible blanket including multiple layers of ballistic cloth stitched together in a quilt pattern to form a fragment barrier, said blanket having an outer surface and an inner surface, each layer of ballistic cloth comprising two internal resin-impregnated fiber sheets wherein the fibers cross at substantial angles, and two facing films of thermoplastic material laminated onto oppositely-facing surfaces of the resin-impregnated fiber sheets, an array of ceramic tiles adhesively attached to the outer surface of said blanket, said tiles having outer surfaces remote from the blanket and inner surfaces adhesively attached to the blanket, said tiles having edges abutted together so that the array of tiles presents an essentially unbroken gap-free surface to an incoming projectile, and a continuous resilient foam spacer pad engaged with the inner surface of said blanket, whereby the blanket is spaced an appreciable distance from the persons body.

25. Body armor according to claim 24, wherein said blanket comprises between forty and fifty-three layers of ballistic cloth.

26. Flexible Armor according to claim 24, wherein:

the outer surface of each ceramic tile of at least a major portion of the tiles has a curved convex contour to cooperate in reducing separation of adjacent tiles upon flexing at joints between tiles.

* * * * *